US007771232B2

(12) United States Patent
Si et al.

(10) Patent No.: US 7,771,232 B2
(45) Date of Patent: Aug. 10, 2010

(54) ELECTRICAL CONNECTOR HAVING A SHELL WITH A PORTION RETAINED IN AN INSULATIVE HOUSING

(75) Inventors: Dong-Dong Si, Kunshan (CN); Chi Zhang, Kunshan (CN); Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,486

(22) Filed: Mar. 25, 2009

(65) Prior Publication Data

US 2009/0247014 A1 Oct. 1, 2009

(30) Foreign Application Priority Data

Mar. 25, 2008 (CN) ..... 2008 2 0033111 U

(51) Int. Cl.
*H01R 13/648* (2006.01)

(52) U.S. Cl. ..... 439/607.01; 439/607.02; 439/607.03; 439/607.04

(58) Field of Classification Search ..... 439/607.01, 439/607.02, 607.03, 607.04
See application file for complete search history.

(56) References Cited

U.S. PATENT DOCUMENTS 6,050,852 A * 4/2000 Wu ..... 439/607.02
6,241,556 B1 * 6/2001 Chih ..... 439/607.01
6,485,328 B1 * 11/2002 Wu ..... 439/567
6,551,139 B1 * 4/2003 Yu ..... 439/607.22
7,134,912 B2 10/2003 Jae
6,755,671 B1 * 6/2004 Fan et al. ..... 439/108
6,767,251 B2 * 7/2004 Yu et al. ..... 439/607.37
6,821,149 B2 * 11/2004 Lai ..... 439/607.31
7,083,470 B2 * 8/2006 Zhang et al. ..... 439/607.36
2005/0095914 A1 * 5/2005 Fan ..... 439/607
2005/0277334 A1 * 12/2005 Huang ..... 439/607

* cited by examiner

*Primary Examiner*—T C Patel
*Assistant Examiner*—Vladimir Imas
(74) *Attorney, Agent, or Firm*—Andrew C. Cheng; Wei Te Chung; Ming Chieh Chang

(57) ABSTRACT

An electrical connector (100) includes an insulative housing (10) comprising a fitting room (13) for receiving a mating connector and a pair of side walls, a plurality of terminals (30) arranged along a longitudinal direction, and a shell (20) coupled to the insulative housing. One side wall of the shell (20) comprises a middle portion (23) received in corresponding one side wall (11*a*) of the insulative housing and a pair of connecting strips (25) integrally connecting with the middle portion and a part of the shell shielding an outside of the insulative housing.

17 Claims, 8 Drawing Sheets

ELECTRICAL CONNECTOR HAVING A SHELL WITH A PORTION RETAINED IN AN INSULATIVE HOUSING

BACKGROUND OF THE INVENTION

1. Field of the Invention

The present invention relates to an electrical connector, especially to an electrical connector having a shell with a middle portion retained in an insulative housing.

2. Description of the Related Art

U.S. Pat. No. 7,134,912 issued on Nov. 14, 2006, discloses an electrical connector including a longitudinal insulative housing with a mating room for receiving a mating connector, a plurality of signal contacts retained in the housing for adapted to electrical connect with the mating connector and a shell covering on the housing. The shell is provided with a body portion surrounding an outer peripheral surface of the insulative housing. A plurality of folding portions are folded inwards to the mating room from the rear edge of the body portion and arranged along the longitudinal direction, which are opposite to a plurality of contacting portions of the signal contacts. The blank metal sheet of shell before the folding portions folded is wide in a front-to-rear direction.

The shell is retained in the housing only with two retaining tails at opposite ends thereof. Therefore the shell would not be well retained in the housing, especially when the mating connector is inserted rudely by bigger force.

Therefore, an improved electrical connector is desired to overcome the disadvantages of the related arts.

SUMMARY OF THE INVENTION

An object of the present invention is to provide an electrical connector with a shell well retained in an insulative housing thereof.

In order to achieve above-mentioned object, an electrical connector in accordance with a preferred embodiment of the present invention includes an insulative housing comprising a fitting room for receiving a mating connector and a pair of side walls, a plurality of terminals arranged along a longitudinal direction, and a shell coupled to the insulative housing. One side wall of the shell comprises a middle portion received in corresponding one side wall of the insulative housing and a pair of connecting strips integrally connecting with the middle portion and a part of the shell shielding outside of the insulative housing. So the shell is well retained in the insulative housing by the aforementioned structure.

Other objects, advantages and novel features of the invention will become more apparent from the following detailed description of the present embodiment when taken in conjunction with the accompanying drawings.

DETAILED DESCRIPTION OF THE INVENTION

Figure 1:
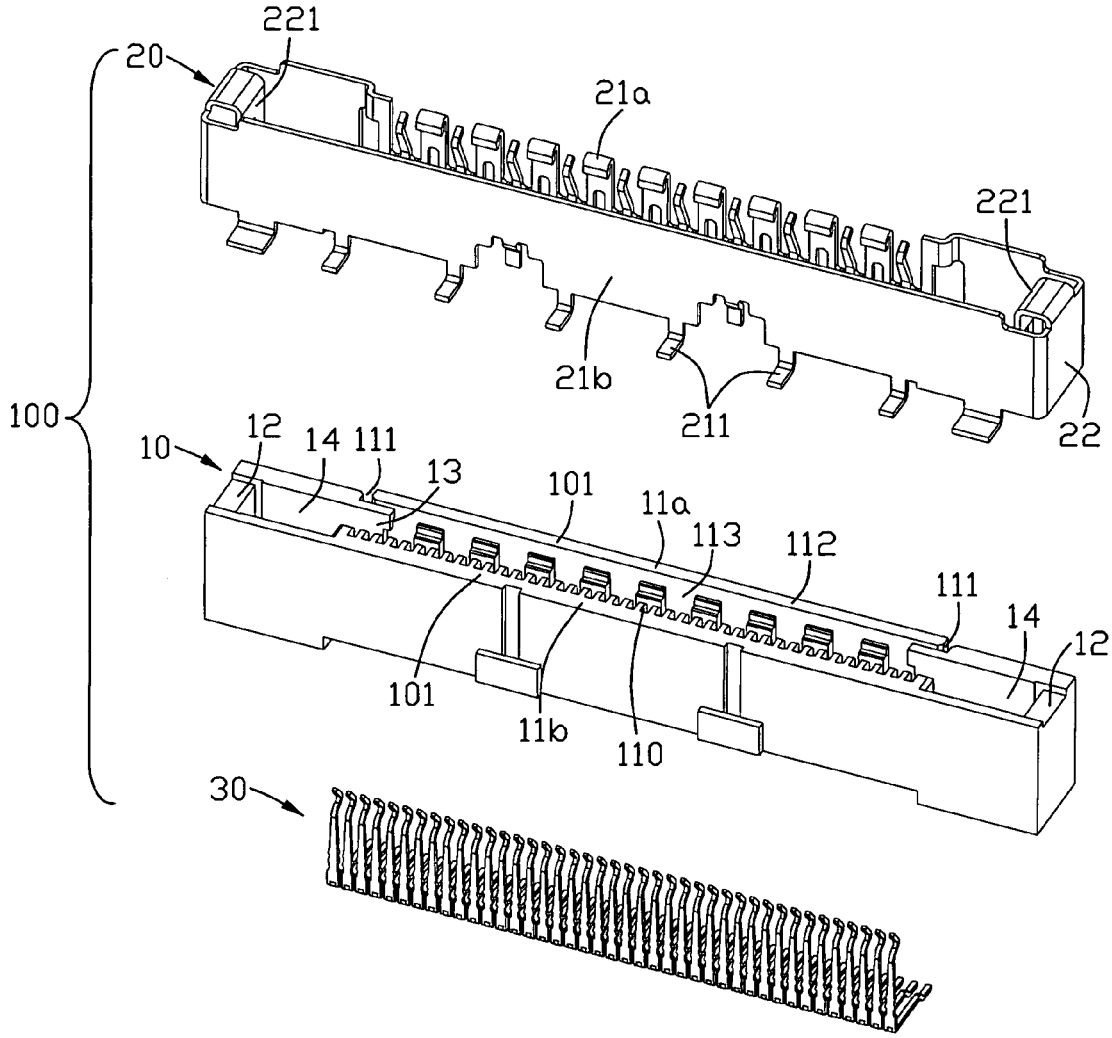
FIG. 1 is an exploded perspective view of an electrical connector in accordance with one preferred embodiment of the present invention.

Reference will now be made to the drawing figures to describe some preferred embodiments of the present invention in detail.

Referring to FIG. 1 to FIG. 5, an electrical connector of one preferred embodiment of the present invention is shown. An electrical connector 100 accordance with the present invention includes an insulative housing 10, a shell 20 of a conductive material coupled to the insulative housing and a plurality of terminals 30 retained in the insulative housing.

Figure 2:
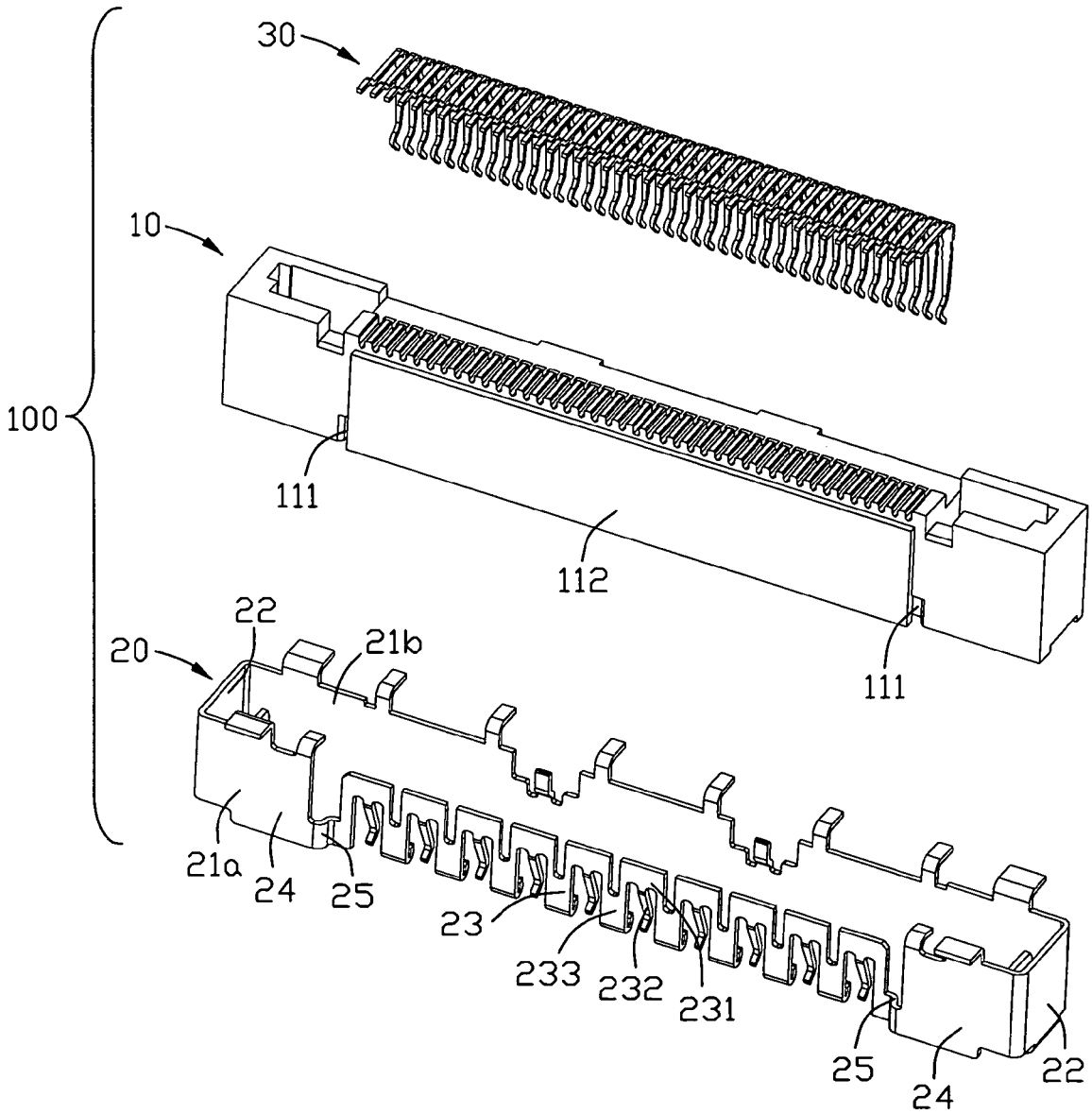
FIG. 2 is another exploded perspective view of the electrical connector of FIG. 1 viewed from a bottom side thereof.

Referring to FIG. 1 and FIG. 2, the insulative housing 10 has a front end 101, the shell 20 is assembled onto the insulative housing from the front end 101. The insulative housing 10 is provided with a pair of parallel longitudinal side walls 11*a*, 11*b* (i.e. a first longitudinal side wall 11*b* and a second longitudinal side wall 11*a*, a plurality of bars separated from each other and a backup wall located behind the plurality of bars serving as a part of the second longitudinal side wall 11*a*) and a pair of end walls 12 integrally linking with the side walls, thereby forming a longitudinal fitting room 13 for receiving a mating connector (not shown) adapted to mate with the electrical connector 100.

The side wall or first side wall 11*b* has a contacting area 110 with a plurality of passageways arrayed along the longitudinal direction to receive the terminals 30. Combination with FIG. 5, the terminals 30 are inserted from a rear end opposite to the front end 101, each terminal 30 includes a holding portion 31 retained in the passageway, a spring portion 32 extending upwards from the holding portion into the fitting room 13 and a soldering portion 33 extending outwards for electrically connecting with a PCB (Printed Circuit Board).

Another side wall or second side wall 11*a* defines a pair of slots 111 parallel running through the front end 101 and communicating with the fitting room 13 and an exterior, thereby the side wall 11*a* is divided with a middle portion 112 which opposite to the contacting area 110. And the middle portion 112 forms a receiving space 113 running through the front end 101 also and communicating the slots 111 along the longitudinal direction.

Figure 3:
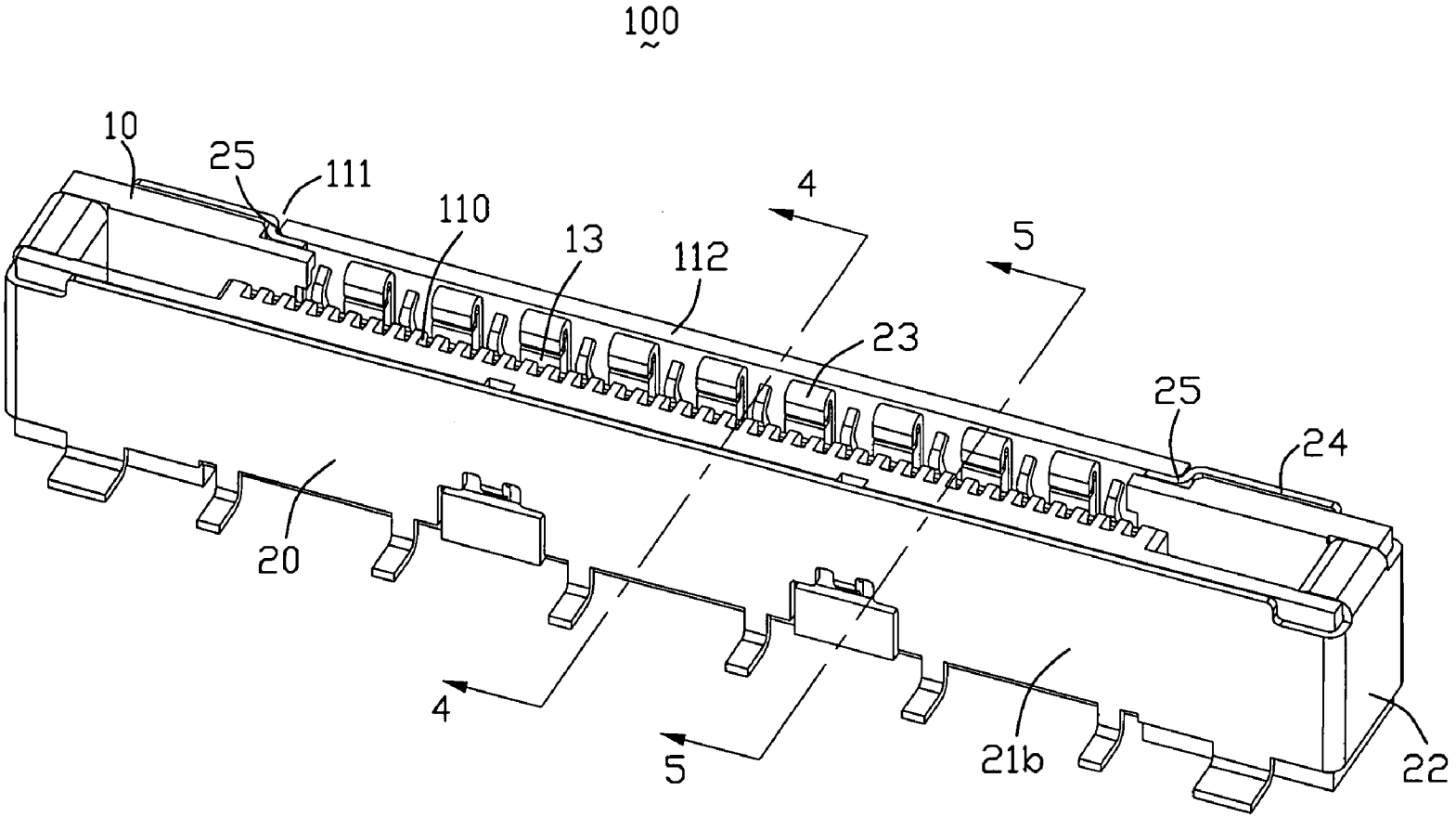
FIG. 3 is a perspective view of the electrical connector of FIG. 1.
Figure 4:
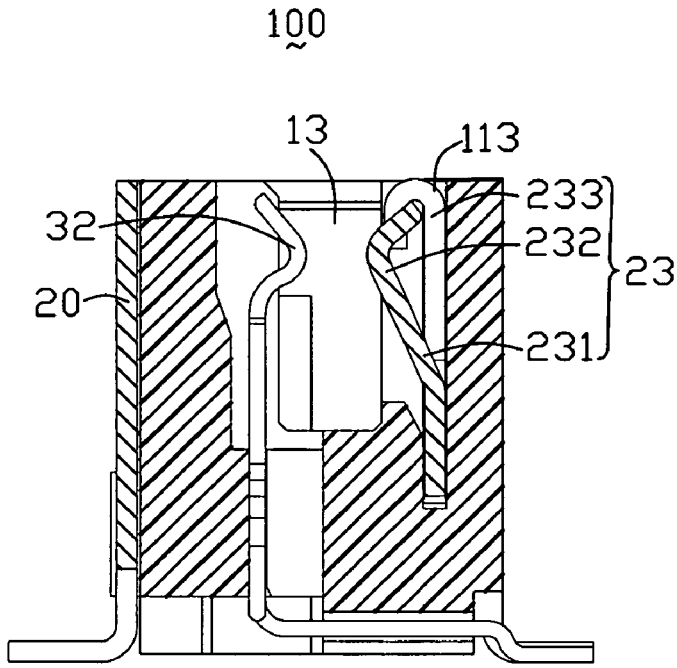
FIG. 4 is a cross-section view of the electrical connector taken along line 4-4 of FIG. 3.

The shell 20 includes a pair of side walls 21*a*, 21*b* (i.e. a first side plate 21*b* and a second side plate or second plate 21*a*) and end walls 22. The side wall or second side plate 21*a* has a middle portion 23 and a pair of end portions 24 connecting with two ends of the middle portion at the longitudinal direction, and the middle portion 23 connects with the end portions 24 by two connecting strips 25. The middle portion 23 is parallel to the end portions and the other side wall or first side wall 21*b*, while the distance between the middle portion and the side wall 21*b* is narrower than that between the end portion 24 and the side wall 21*b*. Referring to FIG. 3 and FIG. 4, the connecting strips 25 are inserted in the slots 111. The middle portion 23 is inserted into and abut against an inside face of the side wall 11*a* and directly faces the fitting room 13. The side wall 21*b*, end walls 22 and the end portion 24 shield the outer peripheral surface of the insulative housing 10. The middle portion 23 substantially corresponds to the contacting area 110.

Figure 5:
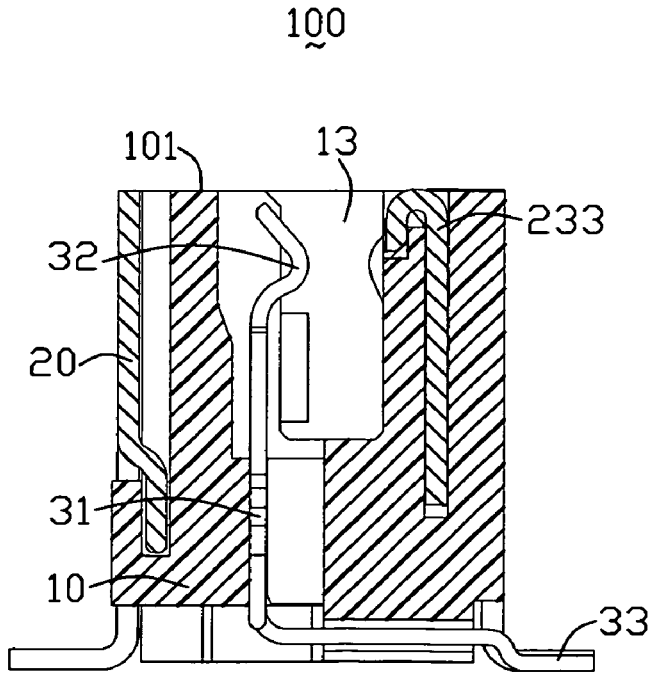
FIG. 5 is a cross-section view of the electrical connector taken along line 5-5 of FIG. 3.
Figure 6:
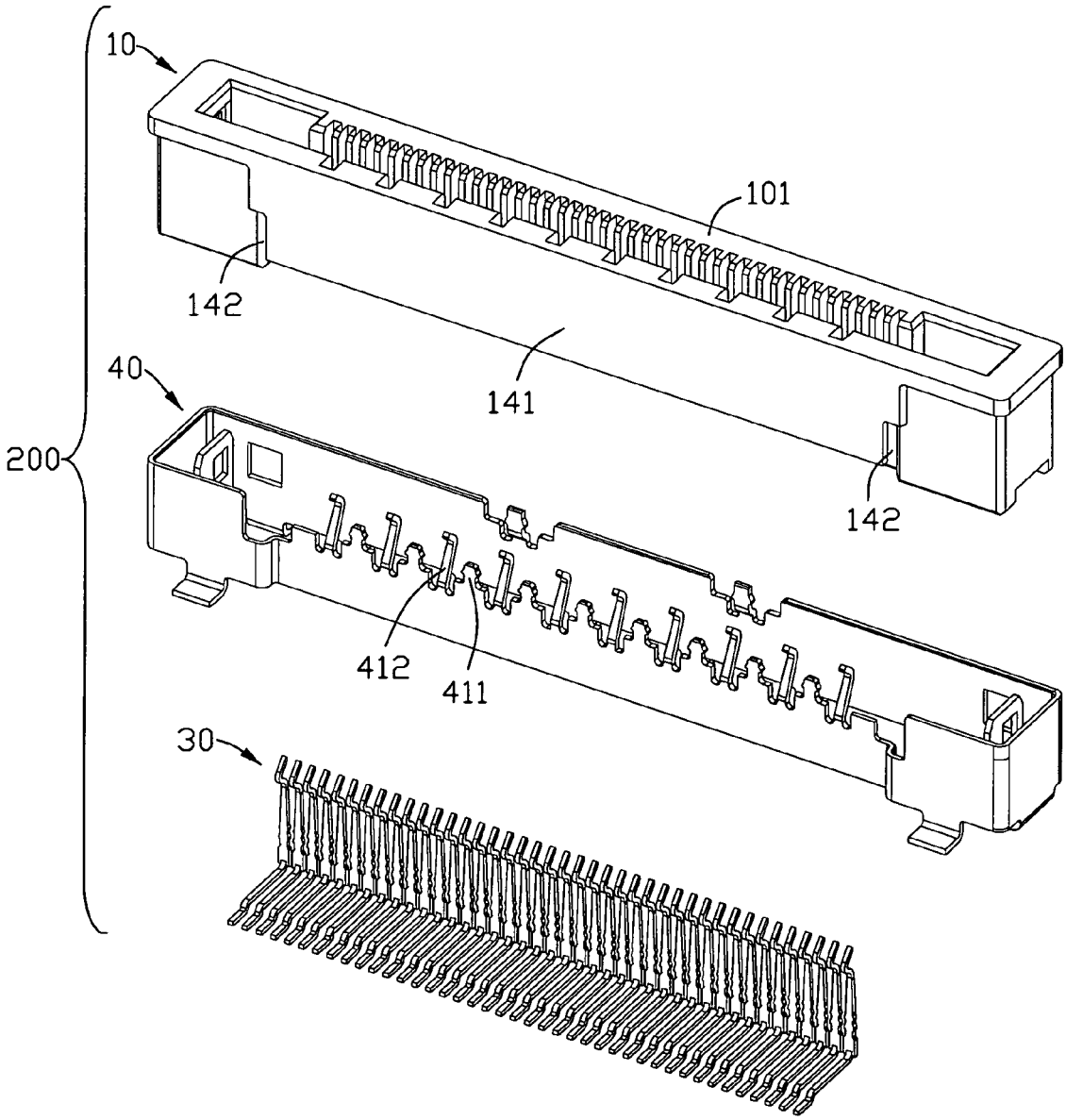
FIG. 6 is an exploded perspective view of the electrical connector in accordance with another preferred embodiment of the present invention.
Figure 7:
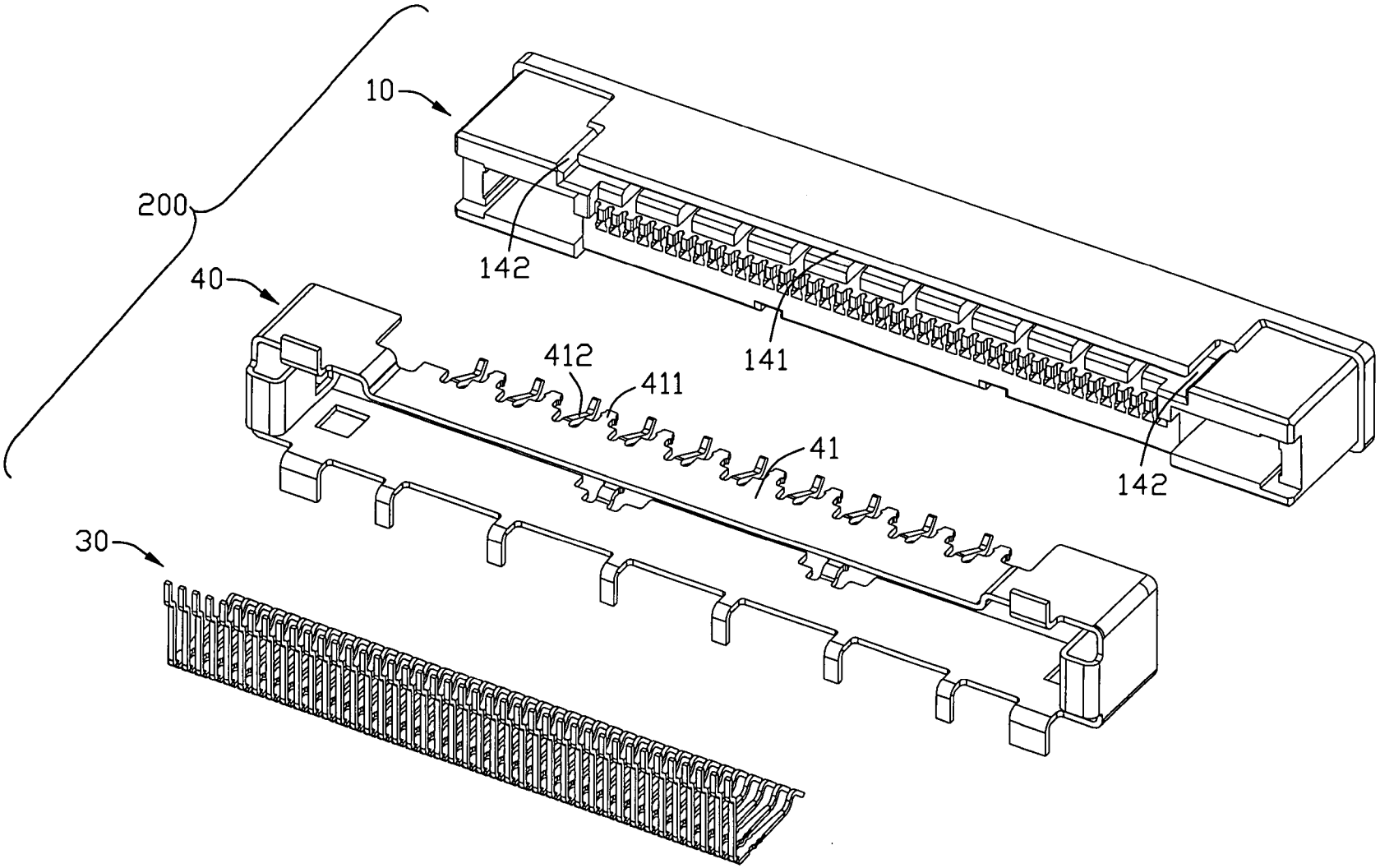
FIG. 7 is another exploded perspective view of the electrical connector of FIG. 6 viewed from a bottom side thereof.
Figure 8:
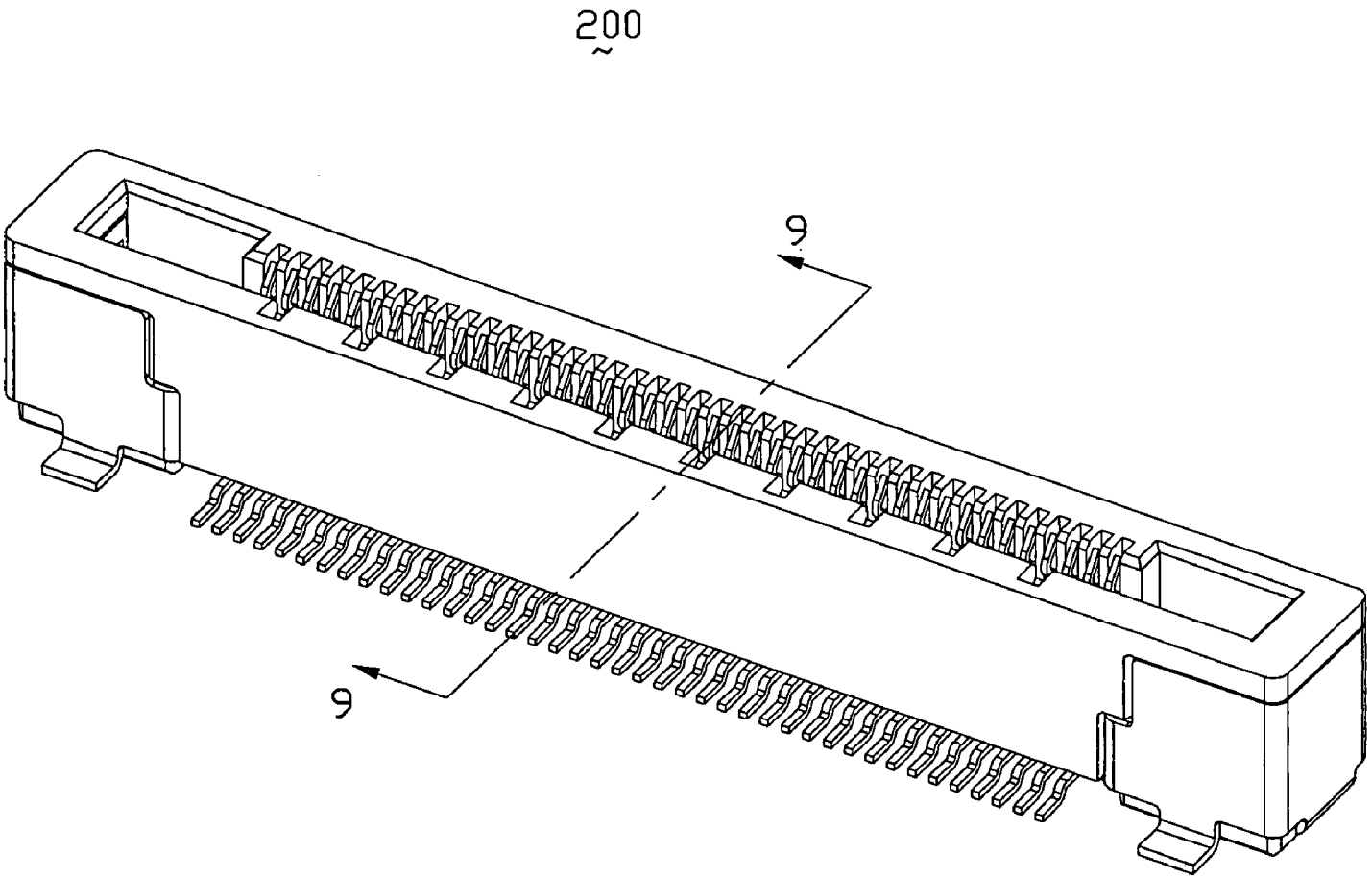
FIG. 8 is a perspective view of the electrical connector of FIG. 7.
Figure 9:
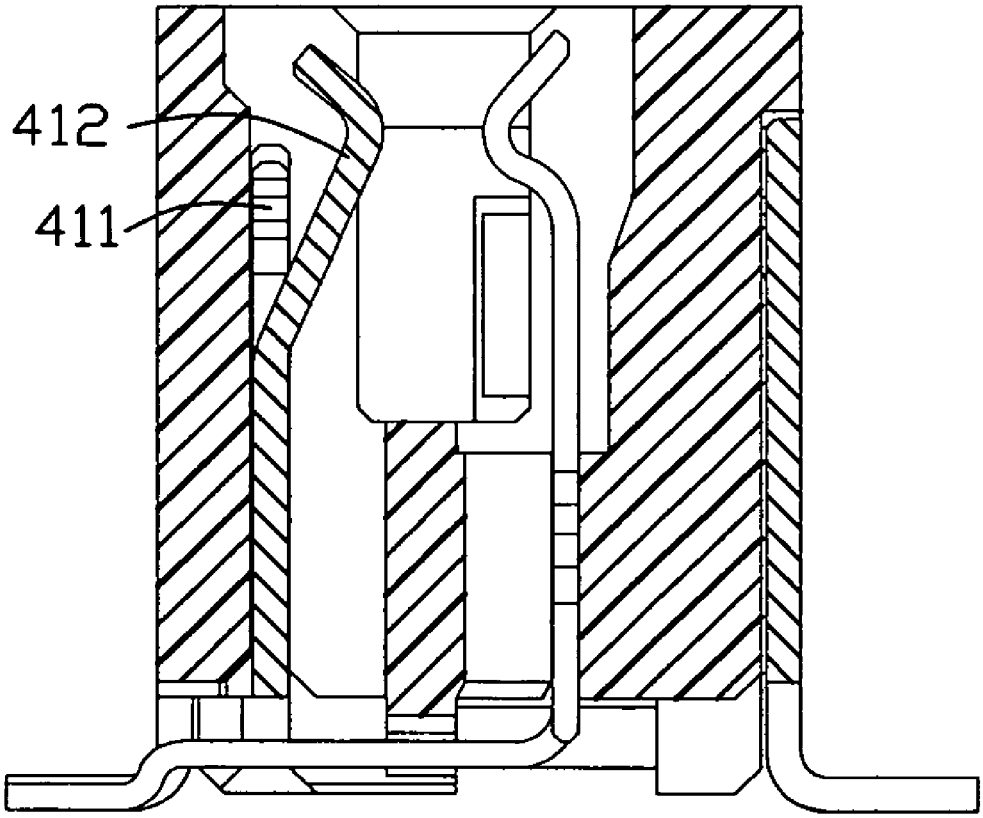
FIG. 9 is a cross-section view of the electrical connector taken along line 9-9 of FIG. 8.

Referring to FIG. 2, FIG. 4 and FIG. 5, the middle portion has a body portion 231 retained in the middle portion 112 of the side wall 11*a*, a plurality of contacting arms or grounding fingers 232 protruding into the fitting room 13 opposite to the spring portions 32 of the terminals, and a plurality of U-shaped bending portions or anchors 233 interlaced with and adjacent to the contacting arm 232 for holding the front of the insulative housing.

Referring to FIG. 1, the end wall 22 has a pair of holding portions 221 extending inwards, and the side walls of the shell include a plurality of soldering tails 211 for electrically connecting with a grounding trace of the PCB. The holding portions 221 separately protrude into a pair of guiding holes 14 defined by two ends of the insulative housing along a plugging direction for guiding the mating connector smoothly to be plugged into the electrical connector. So the end wall 12 of the insulative housing is well retained between the end wall 22 and the holding portion 221.

Referring FIG. 6 to FIG. 9, an electrical connector 200 of another embodiment of the present invention is shown, which is similar to that of aforementioned connector except a described middle portion 41 of a shell 40 and a described middle portion 141 of an insulative housing corresponding to the shell 40.

The middle portion 41 is provided with a plurality of stabs 411 inserted in the insulative housing 10, a plurality of contacting arms 412 adjacent to the stabs, which different from the aforementioned middle portion 23. Because of the reminding structure of the middle portion 41, the shell 40 is inserted into the insulative housing 10 from the rear end opposite to the front end 101. Correspondingly, the middle portion 141 receiving the middle portion 41 is divided by a pair of slot 142 parallel running through the rear end of one side wall of the insulative housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a fitting room for receiving a mating connector and a pair of side walls;

a plurality of terminals arrayed along a longitudinal direction of the insulative housing, each of the terminals comprising a spring portion protruding into the fitting room; and a shell of a conductive material coupled to the insulative housing and comprising a pair of side walls;

wherein one side wall of the shell comprises a middle portion integrally connected between a pair of connecting strips and extending along a longitudinal direction of the insulative housing, the middle portion being received in and sandwiched between the corresponding one side wall of the insulative housing and a pair of bars; a part of the shell disposed on an outside of the insulative housing along the longitudinal direction;

wherein the connecting strip is partially received within the side wall of the insulative housing.

2. The electrical connector as described in claim 1, wherein the corresponding side wall of the insulative housing comprises a pair of slots running through a front side, an inner side and outer side thereof for receiving the connecting strips.

3. The electrical connector as described in claim 1, wherein the part of the shell disposed outside of the insulative housing is a pair of end portions located at both longitudinal ends of the middle portion and integrally connecting with the connecting strips.

4. The electrical connector as described in claim 3, wherein the distance between the middle portion and another side wall of the shell opposite to the middle portion are narrower than that between the end portion and the another side wall of the shell.

5. The electrical connector as described in claim 2, wherein the middle portion of the shell is opposite to the terminals and comprise a body portion retained in the slot and a plurality of contacting arms protruding into the fitting room and alternately arranged with each other along said longitudinal direction for electrically contacting the mating connector.

6. The electrical connector as described in claim 5, wherein the middle portion comprise a plurality of U-shaped bending portions adjacent to the contacting arms for holding one end of the insulative housing.

7. The electrical connector as described in claim 6, wherein the insulative housing comprises a front end and a rent end opposite to the front end, the slots run through the front end thereby the shell is inserted inwards from the front end.

8. The electrical connector as described in claim 5, wherein the middle portion comprises a plurality of stabs retained in the insulative housing.

9. The electrical connector as described in claim 8, wherein the insulative housing comprises a front end and a rear end opposite to the front end, the slots run through the rear end thereby the shell is inserted inwards from the rear end.

10. The electrical connector as described in claim 2, wherein the insulative housing comprise a pair of guiding holes located at longitudinal both ends thereof for guiding the mating connector plugging into thereof and eccentric from the fitting room in a width direction perpendicular to the longitudinal direction for anti-mismating, and the shell comprises a pair of holding portions protruding into the guiding hole along a plugging direction.

11. An electrical connector comprising:

an insulative housing defining an elongated slot confined by opposite first and second elongated side walls extending along a longitudinal direction, and two opposite end walls;

a plurality of passageways formed in an inner face of the first side wall;

a plurality of contacts disposed in the corresponding passageways, respectively;

a metallic shell surrounding the housing and including a first side plate seated upon an exterior face of the first side wall, and a second side plate having a main portion hidden behind an exterior face of the second side wall in an offset manner; wherein said main portion defines a zigzag structure in a vertical direction with a plurality of bending portions, for holding the housing, and a plurality of contact arms, for contacting a mated connector, alternately arranged with each other along said longitudinal direction.

12. The electrical connector as claimed in claim 11, wherein said bending portion is of a downward U-shaped configuration while said contact arm extends upward in a cantilevered manner.

13. The electrical connector as claimed in claim 11, wherein the housing defines a plurality of recesses behind the second side wall to receive the corresponding contact arms therein.

14. The electrical connector as claimed in claim 11, wherein the contacts define corresponding solder tails extending cross the housing in a transverse direction perpendicular to said longitudinal direction and exposed outside of the second side wall.

15. The electrical connector as claimed in claim 11, wherein said shell is downwardly assembled to the housing under condition that said housing defines a pair of slits each to allow an offset section of the second side plate to pass therethrough.

16. A shielded electrical connector, comprising:

an insulative housing defining a first longitudinal sidewall and a pair of end walls interconnecting to the first longitudinal sidewall and jointly defining a receiving space therein, a plurality of bars separated from each other and serving as a second longitudinal sidewall, a backup wall located behind the plurality of bars;

a plurality of contact terminals assembled to the first longitudinal sidewall;

a metallic shell attached to the insulative housing having a plate covering an exterior surface of the first longitudinal sidewall of the insulative housing, and a second plate disposed between the plurality of bars and the backup wall; and the second plate including a plurality of ground fingers disposed between the plurality of bars.

17. The electrical connector as recited in claim 16, wherein the second plate includes a plurality of anchors each interlocked to a top end of the bar.

* * * * *